US010233558B2

(12) United States Patent
Knittel

(10) Patent No.: US 10,233,558 B2
(45) Date of Patent: Mar. 19, 2019

(54) METHOD FOR MANUFACTURING A PART COATED WITH A PROTECTIVE COATING

(71) Applicant: SNECMA, Paris (FR)

(72) Inventor: Stéphane Knittel, Saint-Fargeau-Ponthierry (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 147 days.

(21) Appl. No.: 15/104,457

(22) PCT Filed: Dec. 8, 2014

(86) PCT No.: PCT/FR2014/053206
§ 371 (c)(1),
(2) Date: Jun. 14, 2016

(87) PCT Pub. No.: WO2015/092205
PCT Pub. Date: Jun. 25, 2015

(65) Prior Publication Data

US 2017/0002476 A1 Jan. 5, 2017

(30) Foreign Application Priority Data

Dec. 16, 2013 (FR) ..... 13 62707

(51) Int. Cl.
*C25D 11/02* (2006.01)
*C25D 11/26* (2006.01)
(Continued)

(52) U.S. Cl.
CPC ..... *C25D 11/26* (2013.01); *C25D 11/024* (2013.01); *C25D 11/026* (2013.01); *C25D 21/12* (2013.01)

(58) Field of Classification Search
CPC ..... C25D 11/024; C25D 11/026
USPC ..... 205/107, 322
See application file for complete search history.

(56) References Cited

U.S. PATENT DOCUMENTS 3,956,080 A 5/1976 Hradcovsky et al.
5,720,866 A * 2/1998 Erokhine ..... C25D 5/18 205/106

(Continued)

FOREIGN PATENT DOCUMENTS

DE 10 2006 017 820 A1 10/2007
EP 1 231 299 A1 8/2002

(Continued)

OTHER PUBLICATIONS

Machine translation of FR2877018 of Ruimi et al. (Year: 2006).*

(Continued)

*Primary Examiner* — Brian W Cohen
(74) *Attorney, Agent, or Firm* — Pillsbury Winthrop Shaw Pittman LLP

(57) ABSTRACT

A method of fabricating a part coated with a protective coating, the method including using micro-arc oxidation treatment to form a protective coating on the outside surface of a part, the part including a niobium matrix having metallic silicide inclusions present therein, the current passing through the part being controlled during the micro-arc oxidation treatment in order to subject the part to a succession of current cycles, the ratio of (quantity of positive charge applied to the part)/(quantity of negative charge applied to the part) lying in the range 0.80 to 1.6 for each current cycle.

12 Claims, 3 Drawing Sheets

(51) Int. Cl.
*C25D 21/12* (2006.01)
*C25D 11/00* (2006.01)

(56) References Cited

U.S. PATENT DOCUMENTS

| | | | | |
|---|---|---|---|---|
| 6,214,474 | B1 | 4/2001 | Barbist et al. | |
| 2006/0016690 | A1* | 1/2006 | Ostrovsky | C25D 11/36 205/104 |
| 2010/0025252 | A1* | 2/2010 | Mochizuki | C25D 11/04 205/50 |
| 2012/0000783 | A1* | 1/2012 | Suda | C25D 11/04 205/50 |

FOREIGN PATENT DOCUMENTS

| | | | |
|---|---|---|---|
| EP | 1 818 428 | A1 | 8/2007 |
| FR | 2 877 018 | A1 | 4/2006 |
| JP | 2001-152273 | A | 6/2001 |
| JP | 2001-226734 | A | 8/2001 |
| WO | WO 2012/107754 | A2 | 8/2012 |

OTHER PUBLICATIONS

Machine translation of DE102006017820 of Bewlay et al. (Year: 2007).*

International Search Report as issued in International Patent Application No. PCT/FR2014/053206, dated Apr. 8, 2015.

Portebois, L., et al., "Protective Coatings for Niobium Alloys: Manufacture, Characterization and Oxidation Behaviour of $(TIXCr)_7Si_6$ with X = Fe, Co and Ni," Oxidation of Metals, vol. 80, No. 3-4, Oct. 2013, pp. 243-255, XP055139262, ISSN: 0030-770X.

Plasma Technology and Its Application in Industry 10.4 Plasma Microarc Oxidation Technology, ISBN 978-7-5019-7800-7, (2011), 9 pages.

* cited by examiner

METHOD FOR MANUFACTURING A PART COATED WITH A PROTECTIVE COATING

CROSS-REFERENCE TO RELATED APPLICATIONS

This application is the U.S. National Stage of PCT/FR2014/053206, filed Dec. 8, 2014, which in turn claims priority to French patent application number 1362707, filed Dec. 16, 2013. The content of these applications are incorporated herein by reference in their entireties.

BACKGROUND OF THE INVENTION

The invention relates to parts coated with a protective coating, and to methods of fabricating such parts.

At present, for the hottest parts in turbine engines, only nickel-based superalloys are used on an industrial scale. Although such nickel-based superalloys are coated in a thermal barrier system, their utilization temperature can be limited to 1150° C. because of the proximity of their melting point.

Recent research work has focused on using novel materials based on refractory metals capable of being used at temperatures higher than the utilization temperatures of nickel-based superalloys. These families of materials are commonly referred to as: refractory metal-intermetallic composites (RMICs).

Among the solutions that have been found, niobium-based alloys appear to be particularly promising for replacing, or for being used together with, existing nickel-based superalloys. These various alloys have the advantage of presenting melting points that are higher than those of existing superalloys. Furthermore, niobium-based alloys may also advantageously present densities that are relatively low (6.5 grams per cubic centimeter ($g/cm^3$) to 7 $g/cm^3$, in comparison with 8 $g/cm^2$ to 9 $g/cm^2$ for nickel-based superalloys). Such alloys can thus advantageously serve to reduce significantly the weight of turbine engine parts, e.g. high-pressure turbine blades, because of their low density and their mechanical properties that are close to those of nickel-based superalloys at temperatures close to 1100° C.

In general, niobium-based alloys may include numerous addition elements such as silicon (Si), titanium (Ti), chromium (Cr), aluminum (Al), hafnium (Hf), molybdenum (Mo), or tin (Sn), for example. These alloys present a microstructure constituted by a niobium matrix ($Nb_{ss}$) reinforced by dissolved addition elements in solid solution. This phase provides the alloys with toughness at low temperature. The refractory matrix is associated with precipitates of refractory metal silicides of composition and structure that may vary depending on the addition elements ($M_3Si$, $M_5Si_3$).

These alloys can present particularly advantageous mechanical properties at high temperature (T>1100C.°). Nevertheless, their oxidation behavior when hot can at present limit their use on a large scale. Particularly, when niobium silicide based alloys are exposed to high temperature (greater than 1000° C.), they can oxidize by internal oxidation as a result of oxygen diffusing through the alloy (mainly in the niobium solid solution). A layer may then form on the surface that comprises a mixture of oxides coming from elements contained in the substrate. The resulting oxide layer can present low adhesion without any protection because of the anarchic growth of the unwanted oxides. More or less complex silicates may be formed. Without external assistance, the silicon content of the alloys can be insufficient to generate enough silicates to develop an oxide layer that provides sufficient protection during exposure to high temperature.

There therefore exists a need to improve the ability of niobium-based alloys of this type to withstand corrosion and oxidation when hot.

There also exists a need to have new materials that present both good mechanical properties (toughness when cold and creep at high temperature for moving parts) and also good resistance to corrosion and oxidation at high temperature.

OBJECT AND SUMMARY OF THE INVENTION

The present invention provides a method of fabricating a part coated with a protective coating, the method including the following step:

using micro-arc oxidation treatment to form a protective coating on the outside surface of a part, the part comprising a niobium matrix having metallic silicide inclusions present therein, the current passing through the part being controlled during the micro-arc oxidation treatment in order to subject the part to a succession of current cycles, the ratio of (quantity of positive charge applied to the part)/(quantity of negative charge applied to the part) lying in the range 0.80 to 1.6 for each current cycle.

Advantageously, the present invention makes it possible during the micro-arc oxidation treatment to reach self-regulation conditions. The fact of reaching such conditions is characterized by the electric arc progressively disappearing while the part being subjected to the imposed current cycles is observed with the naked eye.

The invention advantageously makes it possible to form on the surface of the part a protective oxide coating that is dense and that may contain a relatively high content of silicates. Such a protective coating advantageously makes it possible to improve protection against oxidation and corrosion while hot and also to improve the resistance of the material to wear.

Another advantage associated with performing micro-arc oxidation treatment lies in the possibility of making ceramic coatings by an electrochemical technique in an aqueous solution and at low temperature.

Preferably, throughout all or part of the current cycles, the ratio (quantity of positive charge applied to the part)/(quantity of negative charge applied to the part) may lie in the range 0.8 to 0.9.

In an implementation, the part may initially be subjected to a succession of current cycles for which the ratio (quantity of positive charge applied to the part)/(quantity of negative charge applied to the part) lies in the range 0.9 to 1.6, with the part subsequently being subjected to a succession of current cycles for which the ratio (quantity of positive charge applied to the part)/(quantity of negative charge applied to the part) lies in the range 0.8 to 0.9.

Such modulation of the ratio (quantity of positive charge applied to the part)/(quantity of negative charge applied to the part) serves advantageously to accelerate the formation of the protective coating.

In an implementation, for all or some of the current cycles, the ratio (quantity of positive charge applied to the part)/(quantity of negative charge applied to the part) may lie in the range 0.85 to 0.90.

By way of example, the part may include, and in particular may consist of, a niobium matrix having present therein inclusions of metallic silicides selected from $Nb_5Si_3$ and/or $Nb_3Si$.

In an implementation, each current cycle may include a positive stabilization stage during which a constant positive current passes through the part, the duration of the positive stabilization stage lying in the range 15% to 50%, e.g. in the range 17% to 23%, of the total duration of said cycle.

In an implementation, each current cycle may include a negative stabilization stage during which a constant negative current passes through the part, the duration of the negative stabilization stage lying in the range 30% to 80%, e.g. in the range 55% to 65%, of the total duration of said cycle.

In an implementation, the current density passing through the part during the positive stabilization stage may lie in the range 10 amps per square decimeter ($A/dm^2$) to 100 $A/dm^2$, e.g. in the range 50 $A/dm^2$ to 70 $A/dm^2$.

In an implementation, the current density passing through the part during the negative stabilization stage may, in absolute value, lie in the range 10 $A/dm^2$ to 100 $A/dm^2$.

In an implementation, the ratio (current density passing through the part during the negative stabilization stage)/(current density passing through the part during the positive stabilization stage) may have an absolute value lying in the range 30% to 80%, e.g. in the range 50% to 60%.

Preferably, the part may be present in an electrolyte, and prior to the beginning of the micro-arc oxidation treatment, the electrolyte may include a silicate, e.g. present at a concentration that is greater than or equal to 1 gram per liter (g/L), e.g. greater than or equal to 15 g/L. Prior to the beginning of the micro-arc oxidation treatment, the silicate may be present in the electrolyte at a concentration lying in the range 1 g/L to Cs, where Cs designates the limit concentration for solubility of the silicate in the electrolyte. For example, Cs may be equal to 300 g/L.

Such electrolytes advantageously make it possible to further increase the content of silicates present in the protective coating that is obtained, and thus further improve the corrosion resistance of the coated part.

By way of example, the solvent of the electrolyte may be water.

By way of example, the pH of the electrolyte may lie in the range 10 to 14 during all or some of the micro-arc oxidation treatment.

In an implementation, the part is present in an electrolyte, and throughout all or some of the micro-arc oxidation treatment, the electrolyte may be maintained at a temperature less than or equal to 40° C., e.g. less than or equal to 20° C.

Under such circumstances, a cooling system may serve to maintain the electrolyte at such temperatures. It is part of the general knowledge of the person skilled in the art to adapt the cooling that is performed so as to maintain the electrolyte at these temperatures.

In an implementation, the duration for which the part is subjected to micro-arc oxidation treatment may be greater than or equal to 10 minutes, e.g. may lie in the range 10 minutes to 60 minutes.

In an implementation, the part may be subjected to micro-arc oxidation treatment enabling self-regulation conditions to be reached, and self-regulation conditions may then be maintained for a duration that is less than or equal to 10 minutes, e.g. for a duration lying in the range 3 minutes to 10 minutes.

In an implementation, each current cycle includes a positive current rise stage during which the current passing through the part is positive and strictly increasing, the duration of the positive current rise stage possibly lying in the range 3% to 15%, e.g. in the range 9% to 13%, of the total duration of said cycle.

In an implementation, each current cycle includes a positive current descent stage during which the current passing through the part is positive and strictly decreasing, the duration of the positive current descent stage possibly lying in the range 1% to 10%, e.g. in the range 1.5% to 2.5% of the total duration of said cycle.

In an implementation, each current cycle includes a zero current stabilization stage during which no current passes through the part, the duration of the zero current stabilization stage possibly lying in the range 0.5% to 1.5% of the total duration of said cycle.

In an implementation, each current cycle includes a negative current descent stage during which the current passing through the part is negative and strictly decreasing, the duration of the negative current descent stage possibly lying in the range 1% to 10%, e.g. 2.5% to 3.5% of the total duration of said cycle.

In an implementation, each current cycle includes a negative current rise stage during which the current passing through the part is negative and strictly increasing, the duration of the negative current rise stage possibly lying in the range 1% to 10%, e.g. in the range 1.5% to 2.5%, of the total duration of said cycle.

In an implementation, each current cycle comprises:

- a positive current rise stage during which the current passing through the part is positive and strictly increasing, the duration of the positive current rise stage lying for example in the range 3% to 15%, e.g. in the range 9% to 13%, of the total duration of said cycle; then
- a positive stabilization stage during which a constant positive current passes through the part, the duration of the positive stabilization stage lying for example in the range 15% to 50%, e.g. in the range 17% to 23%, of the total duration of said cycle; then
- a positive current descent stage during which the current passing through the part is positive and strictly decreasing, the duration of the positive current descent stage lying for example in the range 1% to 10%, e.g. in the range 1.5% to 2.5%, of the total duration of said cycle; then
- optionally a zero current stabilization stage during which no current passes through the part, the duration of the zero current stabilization stage lying for example in the range 0.5% to 1.5%, of the total duration of said cycle; then
- a negative current descent stage during which the current passing through the part is negative and strictly decreasing, the duration of the negative current descent stage lying for example in the range 1% to 10%, e.g. in the range 2.5% to 3.5%, of the total duration of said cycle; then
- a negative stabilization stage during which a constant negative current passes through the part, the duration of the negative stabilization stage lying for example in the range 30% to 80%, e.g. in the range 55% to 65%, of the total duration of said cycle; and then
- a negative current rise stage during which the current passing through the part is negative and strictly increasing, the duration of the negative current rise stage lying for example in the range 1% to 10%, e.g. in the range 1.5% to 2.5%, of the total duration of said cycle.

In an implementation, the part is present in an electrolyte and during the micro-arc oxidation treatment, the current may pass through the part and also through a counter-electrode present in the electrolyte, the counter-electrode having the same shape as the part.

The use of a counter-electrode of shape adapted to that of the part makes it possible, advantageously, for parts of relatively complex shape to avoid problems of how current lines are distributed. More generally, whatever the shape of the counter-electrode, it may be situated at a distance lying in the range 1 centimeter (cm) to 20 cm from the part. For example, the counter-electrode is situated at 2.5 cm from the part.

It is advantageous for the part to be separated from the counter-electrode by a distance that is less than or equal to 20 cm in order to minimize current loses in the electrolyte and increase the effectiveness of the method. Furthermore, it is advantageous for the part to be spaced apart from the counter-electrode by a distance that is greater than or equal to 1 cm, in order to limit the impact of edge effects.

In an implementation, the applied current cycles may be periodic. In an implementation, the frequency of the current cycles may lie in the range 50 hertz (Hz) to 1000 Hz, e.g. in the range 50 Hz to 150 Hz.

The thickness of the coating formed may be greater than or equal to 20 micrometers (μm), preferably greater than or equal to 50 μm. The thickness of the coating that is formed may for example lie in the range 100 μm to 150 μm.

By way of example, the part may constitute a turbine engine blade. Also by way of example, the part may constitute a turbine engine valve or nozzle.

The present invention also relates to a part coated by a protective coating suitable for being obtained by performing a method as described above, and it also relates to a turbine engine including such a part.

For the purpose of improving resistance to oxidation of a part, the present invention also relates to the use of micro-arc oxidation treatment in which the part comprising a niobium matrix having inclusions of metallic silicides present therein is subjected to a succession of current cycles, the ratio (quantity of positive charge applied to the part)/(quantity of negative charge applied to the part) lying in the range 0.80 to 1.6, for each current cycle.

For the purpose of improving the resistance to wear of a part, the present invention also provides the use of micro-arc oxidation treatment in which a part comprising a niobium matrix having inclusions of metallic silicides present therein is subjected to a succession of current cycles, the ratio (quantity of positive charge applied to the part)/(quantity of negative charge applied to the part) lying in the range 0.80 to 1.6, for each current cycle.

The present invention also provides a method of fabricating a part coated with a protective coating, the method including the following step:

using micro-arc oxidation treatment to form a protective coating on the outside surface of a part, the part comprising a niobium matrix having metallic silicide inclusions present therein, self-regulation conditions being reached during the micro-arc oxidation treatment.

The characteristics and advantages described above apply to this last aspect of the invention.

BRIEF DESCRIPTION OF THE DRAWINGS

Other characteristics and advantages of the present invention appear from the following description of particular implementations of the invention, given as non-limiting examples, and with reference to the accompanying drawings, in which.

DETAILED DESCRIPTION OF IMPLEMENTATIONS

Figure 1:
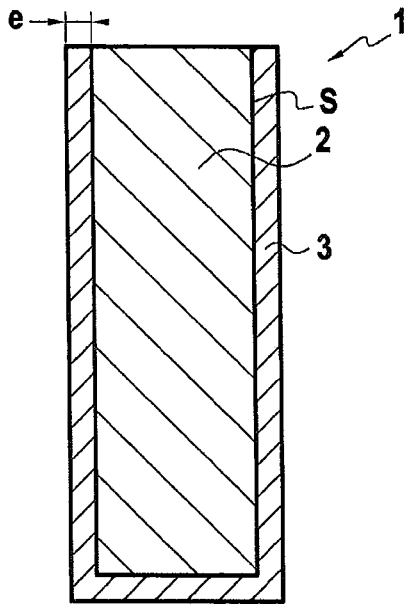
FIG. 1 is a diagrammatic and fragmentary section of a part coated with a protective coating obtained by performing a method of the invention.

FIG. 1 is a section view of a part 1 having a protective coating. A protective coating 3 is formed on the outside surface S of the part 2 comprising a niobium matrix having metallic silicide inclusions present therein.

The thickness e of the coating 3 that is formed may lie in the range 20 μm to 150 μm, for example.

Figure 2:
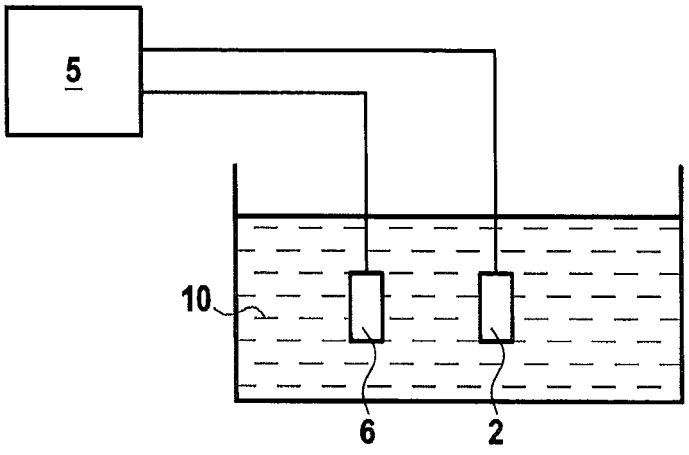
FIG. 2 is a diagrammatic and fragmentary view of an experimental set-up for performing a method of the invention.

FIG. 2 shows an experimental set-up for performing micro-arc oxidation treatment that is usable in the context of the present invention. The part 2 is immersed in an electrolyte 10 including silicates. A counter-electrode 6 is present facing the part 2 and it is likewise immersed in the electrolyte 10. In a variant that is not shown, counter-electrodes are present on both sides of the part. By way of example, this counter-electrode 6 may be cylindrical in shape, and by way of example it may be constituted by a 304L stainless steel. The part 2 and the counter-electrode 6 are connected to a generator 5 that subjects them to a succession of current cycles.

While performing the method of the invention, a first oxide layer is formed initially on the outside surface S of the treated part 2. Sufficient current is applied to reach the electrical breakdown point of the first oxide layer initially formed on the surface S of the part 2. Electric arcs are then generated and lead to a plasma being formed at the surface S of the treated part 2. The protective coating 3 is then formed by converting the elements contained in the part 2, and also by incorporating elements contained in the electrolyte 10. The experimental set-up used also includes a cooling system (not shown) for limiting the heating of the electrolyte during the micro-arc oxidation treatment.

Figure 3:
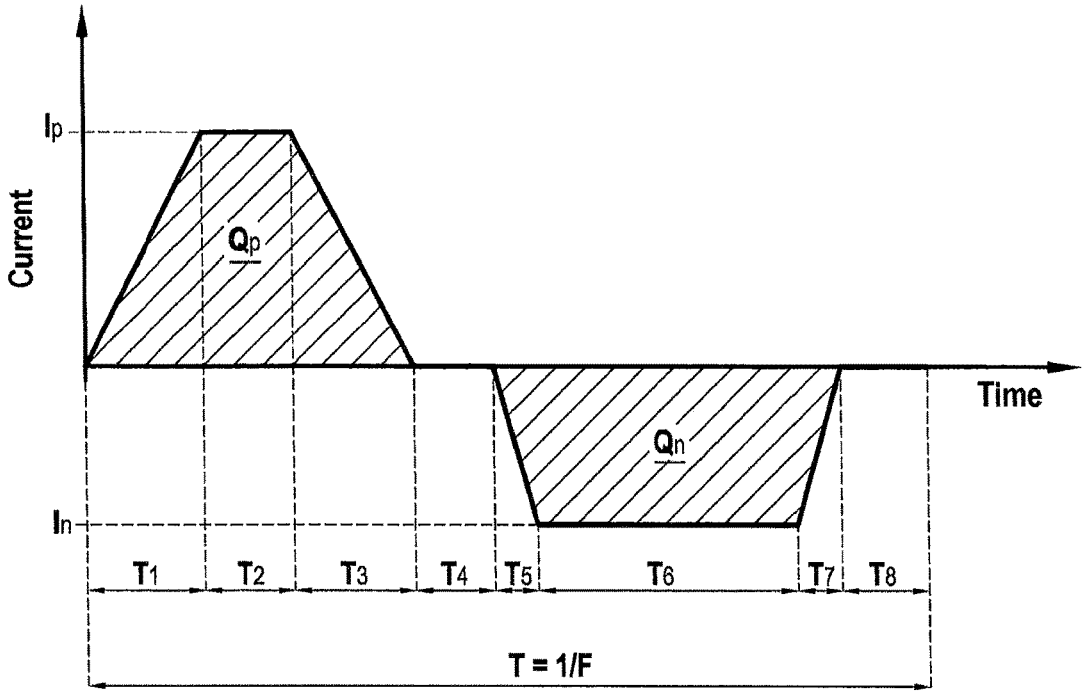
FIG. 3 is a diagrammatic view showing an example of a current cycle suitable for use in micro-arc oxidation treatment of the invention.

A succession of periodic current cycles are applied to the part 2. The wave-form of one of the applied current cycles is shown in FIG. 3. The parameters are given in Table 1 below:

TABLE 1

| | |
|---|---|
| $I_p$: current passing through the part during the positive stabilization stage | $T_1$: duration of the positive current rise stage |
| $I_n$: current passing through the part during the negative stabilization stage | $T_2$: duration of the positive stabilization stage |
| $Q_p$: quantity of positive charge applied to the part during the current cycle | $T_3$: duration of the positive current descent stage |
| $Q_n$: quantity of negative | $T_4$: duration of the zero current stabilization stage |
| | $T_5$: duration of the negative current descent stage |

TABLE 1-continued

| | |
|---|---|
| charge applied to the part during the current cycle<br>T: period of current cycles<br>F: frequency of current cycles | $T_6$: duration of the negative stabilization stage<br>$T_7$: duration of the negative current rise stage<br>$T_8$: duration of the zero current stabilization stage |

As shown in FIG. 3, each of the applied current cycles may comprise the following succession of stages:

a positive current rise stage, then a positive stabilization stage, then a positive current descent stage, then optionally a zero current stabilization stage, then a negative current descent stage, then a negative stabilization stage, then a negative current rise stage.

The total duration of the current cycle corresponds to the following sum:

$$\sum_{i=1}^{7} T_i$$

i.e. the duration between the beginning of the positive current rise stage and the end of the negative current rise stage. The frequency of the current cycles corresponds to the following magnitude:

$$\frac{1}{\sum_{i=1}^{8} T_i}$$

Figure 4:
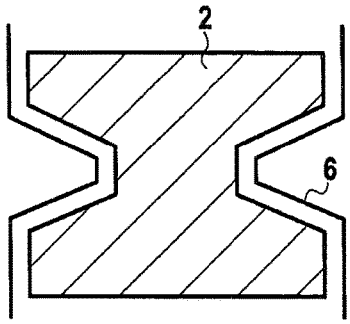
FIG. 4 is a diagrammatic and fragmentary view of a variant embodiment of a counter-electrode usable in the context of a method of the invention.

FIG. 4 shows a variant implementation in which the counter-electrode 6 is of a shape that matches the shape of the part 2.

As shown, the counter-electrode 6 may be similar in shape to the part 2 and it may fit closely around its shape. The part and the counter-electrode may also both be cylindrical or plane in shape.

EXAMPLE

A substrate was treated by a method of the invention. Table 2 below gives the operating conditions (the times are expressed as a percentage of the total duration of the current cycle). The imposed cycle comprised the same succession of stages as the current cycle shown in FIG. 3.

TABLE 2

| Electrical parameters | Composition of the electrolyte before the beginning of the micro-arc oxidation treatment | Composition of the basic substrate before the beginning of the micro-arc oxidation treatment (% atomic): MASC alloy (described in U.S. Pat. No. 5,942,055) |
|---|---|---|
| I (A) = 11<br>R = $I_n/I_p$ = 55%<br>Frequency = 100 Hz<br>$Q_p/Q_n$ = 0.87<br>T1 = 11% | NaOH = 0.4 g/L<br>$Na_2SiO_2,5H_2O$ = 15 g/L<br>pH 12-13<br>solvent = water | Nb = 47%<br>Ti = 25%<br>Hf = 8%<br>Cr = 2%<br>Al = 2% |

TABLE 2-continued

| Electrical parameters | Composition of the electrolyte before the beginning of the micro-arc oxidation treatment | Composition of the basic substrate before the beginning of the micro-arc oxidation treatment (% atomic): MASC alloy (described in U.S. Pat. No. 5,942,055) |
|---|---|---|
| T2 = 20%<br>T3 = 2%<br>T4 = 1%<br>T5 = 3%<br>T6 = 61%<br>T7 = 2% | | Si = 16% |

After about 30 minutes of treatment, self-regulation conditions were reached, characterized by progressive extinction of the electric arc. The samples continued to be treated for five additional minutes under self-regulation conditions so as to grow the oxide layer being formed and improve its compactness.

The operating conditions advantageously enable a relatively dense protective coating to be formed having thickness equal to approximately 150 μm at the surface of the treated test piece.

Figure 5:
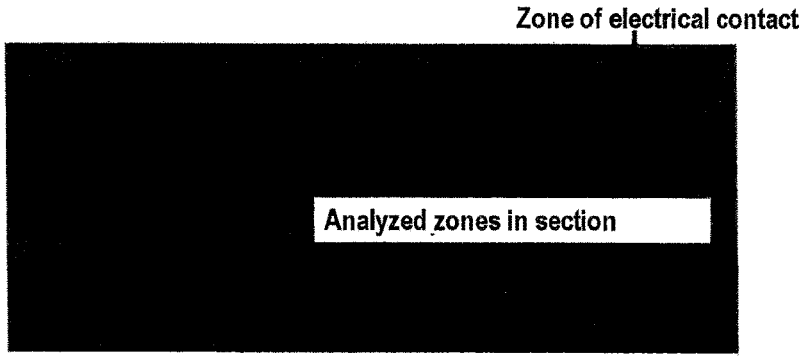
FIG. 5 is a photograph of the results obtained after using a method of the invention to treat a part having a niobium matrix with inclusions of metallic silicides present therein.

After treatment, the bar appeared to be perfectly coated. Its macroscopic appearance is shown in FIG. 5.

Figure 6A:
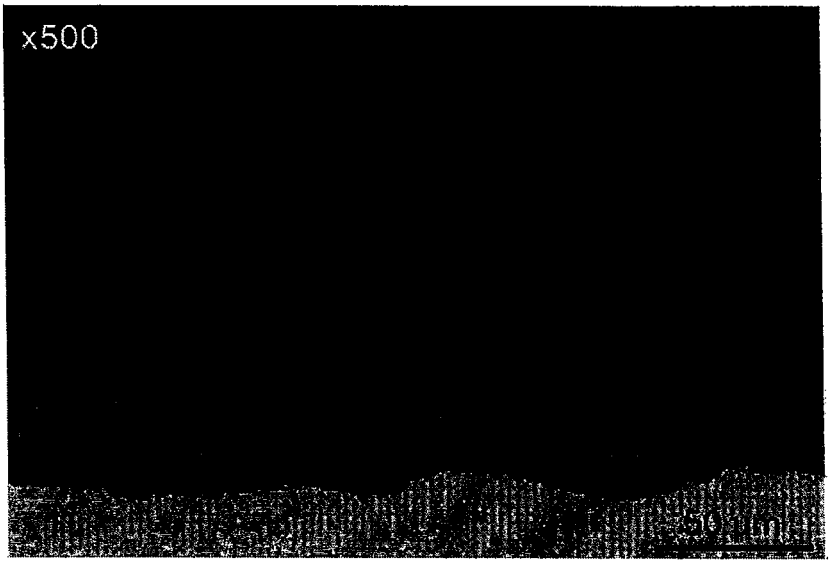
FIGS. 6A and 6B are scanning electron microscope section views of the protective coating formed at the surface of the FIG. 5 part.
Figure 6B:
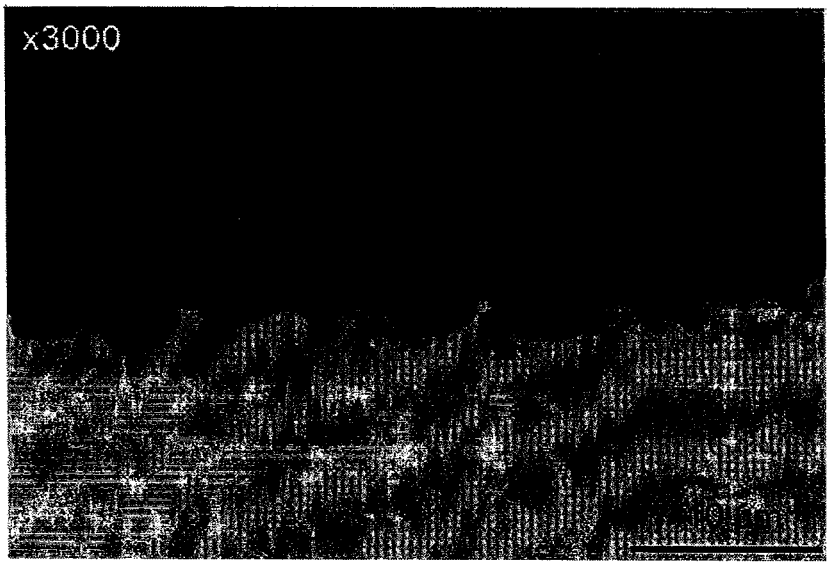

The layer formed on the surface of the substrate was characterized by scanning electron microscopy (see FIGS. 6A and 6B). The layer that was formed revealed a uniform appearance over the entire circumference of the bar and in the two zones analyzed.

The coating formed by micro-arc anodic oxidation adhered perfectly.

The term "including/containing a" should be understood as "including/containing at least one".

The term "lying in the range . . . to . . . " should be understood as including these limits.

The invention claimed is:

1. A method of fabricating a part coated with a protective coating, the method comprising:

using micro-arc oxidation treatment to form a protective coating on an outside surface of a part, the part comprising a niobium matrix having metallic silicide inclusions present therein, a current passing through the part being controlled during the micro-arc oxidation treatment in order to subject the part to a succession of current cycles, a ratio of (quantity of positive charge applied to the part)/(quantity of negative charge applied to the part) lying in the range 0.80 to 1.6 for each current cycle, wherein each current cycle includes:

a positive current rise stage during which the current passing through the part is positive and increasing, the duration of the positive current rise stage lying in the range 3% to 15% of the total duration of said cycle, and a positive stabilization stage during which a constant positive current passes through the part, the positive stabilization stage being performed after the positive current rise stage, the duration of the positive stabilization stage lying in the range 15% to 50% of the total duration of said cycle.

2. A method according to claim 1, wherein each current cycle includes a negative stabilization stage during which a constant negative current passes through the part, a duration of the negative stabilization stage lying in the range 30% to 80% of a total duration of said cycle.

3. A method according to claim 1, wherein the part is present in an electrolyte, and wherein prior to the beginning of the micro-arc oxidation treatment the electrolyte includes a silicate.

4. A method according to claim 1, wherein the part is present in an electrolyte, and wherein throughout all or part of the micro-arc oxidation treatment, the electrolyte is maintained at a temperature less than or equal to 40° C.

5. A method according to claim 1, wherein the part is present in an electrolyte, and wherein during the micro-arc oxidation treatment, the current passes through the part and through a counter-electrode present in the electrolyte, the counter-electrode having a same shape as the part.

6. A method according to claim 1, wherein the duration during which the part is subjected to micro-arc oxidation treatment is greater than or equal to 10 minutes.

7. A method according to claim 1, wherein the part is subjected to a micro-arc oxidation treatment enabling self-regulation conditions to be achieved, said self-regulation conditions then being maintained for a duration lying in the range 3 minutes to 10 minutes.

8. A method according to claim 1, wherein, for all or part of the current cycles, the ratio (quantity of positive charge applied to the part)/(quantity of negative charge applied to the part) lies in the range 0.8 to 0.9.

9. A method according to claim 1, wherein the part is initially subjected to a succession of current cycles for which the ratio (quantity of positive charge applied to the part)/(quantity of negative charge applied to the part) lies in the range 0.9 to 1.6, the part subsequently being subjected to a succession of current cycles for which the ratio (quantity of positive charge applied to the part)/(quantity of negative charge applied to the part) lies in the range 0.8 to 0.9.

10. A method of fabricating a part coated with a protective coating, the method comprising:

using micro-arc oxidation treatment to form a protective coating on an outside surface of a part, the part comprising a niobium matrix having metallic silicide inclusions present therein, a current passing through the part being controlled during the micro-arc oxidation treatment in order to subject the part to a succession of current cycles, a ratio of (quantity of positive charge applied to the part)/(quantity of negative charge applied to the part) lying in the range 0.80 to 1.6 for each current cycle, wherein each current cycle includes:

a positive stabilization stage during which a constant positive current passes through the part, the duration of the positive stabilization stage lying in the range 15% to 50% of the total duration of said cycle, and a positive current descent stage during which the current passing through the part is positive and decreasing, the duration of the positive current descent stage lying in the range 1% to 10% of the total duration of said cycle, the positive current descent stage being performed after the positive stabilization stage.

11. A method of fabricating a part coated with a protective coating, the method comprising:

using micro-arc oxidation treatment to form a protective coating on an outside surface of a part, the part comprising a niobium matrix having metallic silicide inclusions present therein, a current passing through the part being controlled during the micro-arc oxidation treatment in order to subject the part to a succession of current cycles, a ratio of (quantity of positive charge applied to the part)/(quantity of negative charge applied to the part) lying in the range 0.80 to 1.6for each current cycle, wherein each current cycle includes:

a negative current descent stage during which the current passing through the part is negative and decreasing, the duration of the negative current descent stage lying in the range 1% to 10% of the total duration of said cycle, and a negative stabilization stage during which a constant negative current passes through the part, the negative stabilization stage being performed after the negative current descent stage, the duration of the negative stabilization stage lying in the range 30% to 80% of the total duration of said cycle.

12. A method of fabricating a part coated with a protective coating, the method comprising:

using micro-arc oxidation treatment to form a protective coating on an outside surface of a part, the part comprising a niobium matrix having metallic silicide inclusions present therein, a current passing through the part being controlled during the micro-arc oxidation treatment in order to subject the part to a succession of current cycles, a ratio of (quantity of positive charge applied to the part)/(quantity of negative charge applied to the part) lying in the range 0.80 to 1.6 for each current cycle, wherein each current cycle includes:

a negative stabilization stage during which a constant negative current passes through the part, the duration of the negative stabilization stage lying in the range 30% to 80% of the total duration of said cycle, and a negative current rise stage during which the current passing through the part is negative and increasing, the negative current rise stage being performed after the negative stabilization stage, the duration of the negative current rise stage lying in the range 1% to 10% of the total duration of said cycle.

* * * * *